US011420314B2

(12) United States Patent
Tada et al.

(10) Patent No.: US 11,420,314 B2
(45) Date of Patent: Aug. 23, 2022

(54) IMPACT TOOL

(71) Applicant: MAKITA CORPORATION, Anjo (JP)

(72) Inventors: Yoshiro Tada, Anjo (JP); Kei Watanabe, Anjo (JP); Tetsuhisa Kaneko, Anjo (JP)

(73) Assignee: MAKITA CORPORATION, Anjo (JP)

( * ) Notice: Subject to any disclaimer, the term of this patent is extended or adjusted under 35 U.S.C. 154(b) by 218 days.

(21) Appl. No.: 16/391,633

(22) Filed: Apr. 23, 2019

(65) Prior Publication Data

US 2019/0344416 A1 Nov. 14, 2019

(30) Foreign Application Priority Data

May 14, 2018 (JP) ..... JP2018-093330
Sep. 25, 2018 (JP) ..... JP2018-179038

(51) Int. Cl.
*B25D 11/12* (2006.01)
*B25D 17/04* (2006.01)

(52) U.S. Cl.
CPC ..... *B25D 17/04* (2013.01); *B25D 11/12* (2013.01); *B25D 2250/121* (2013.01); *B25D 2250/261* (2013.01); *B25D 2250/265* (2013.01)

(58) Field of Classification Search
CPC ..... B25D 2250/265; H01H 3/20; H01H 9/20; H01H 9/06; H01H 13/08; H01H 9/22; H01H 2300/024
USPC ..... 173/171, 20
See application file for complete search history.

(56) References Cited

U.S. PATENT DOCUMENTS 5,360,073 A * 11/1994 Akazawa ..... B25B 21/00 173/15
5,653,296 A * 8/1997 Fujiyama ..... H01H 13/08 173/170
6,938,706 B2 * 9/2005 Ng ..... B25F 5/02 173/170

(Continued)

FOREIGN PATENT DOCUMENTS

JP H11-347968 A 12/1999
JP 2001-210165 A 8/2001

(Continued)

OTHER PUBLICATIONS

Mar. 29, 2022 Office Action issued in Japanese Patent Application No. 2018-179038.

*Primary Examiner* — Thanh K Truong
*Assistant Examiner* — Patrick B Fry
(74) *Attorney, Agent, or Firm* — Oliff PLC

(57) ABSTRACT

An impact tool includes a switch for driving the tool accessory, an operation member configured to be movable between an OFF position and an ON position, a first lock member configured to lock the operation member in the ON position, a second lock member configured to be movable between a lock position and a lock-release position in response to an external operation by a user, and a holding mechanism configured to hold the second lock member in the lock position and also in the lock-release position. The second lock member in the lock position is capable of locking the operation member in the OFF position, and the second lock member in the lock-release position is incapable of locking the operation member in the OFF position.

11 Claims, 15 Drawing Sheets

(56) References Cited

U.S. PATENT DOCUMENTS

| | | | | |
|---|---|---|---|---|
| 8,286,724 | B2 * | 10/2012 | Furusawa | H01H 9/06 173/47 |
| 9,316,352 | B2 * | 4/2016 | Thorson | F16N 5/00 |
| 10,014,128 | B2 * | 7/2018 | Kannan | H01H 9/22 |
| 10,751,868 | B2 * | 8/2020 | Tada | B25D 17/043 |
| 2003/0089511 | A1 * | 5/2003 | Tsuneda | B25B 21/00 173/217 |
| 2011/0005905 | A1 * | 1/2011 | Fukinuki | B25F 5/02 200/43.18 |
| 2011/0180286 | A1 * | 7/2011 | Oomori | H02K 7/145 173/20 |
| 2013/0087583 | A1 | 4/2013 | Thorson et al. | |
| 2015/0170848 | A1 | 6/2015 | Kannan et al. | |
| 2016/0151905 | A1 * | 6/2016 | Tada | B25D 17/20 173/210 |
| 2016/0322183 | A1 * | 11/2016 | Vogel | H01H 21/10 |

FOREIGN PATENT DOCUMENTS

| | | | |
|---|---|---|---|
| JP | 2008-119755 | A | 5/2008 |
| JP | 2016-107394 | A | 6/2016 |

* cited by examiner

IMPACT TOOL

CROSS-REFERENCE TO RELATED APPLICATION

The present application claims priorities to Japanese patent application No. 2018-093330 filed on May 14, 2018, and Japanese patent application No. 2018-179038 filed on Sep. 25, 2018. The contents of the foregoing applications are fully incorporated herein by reference.

TECHNICAL FIELD

The present disclosure relates to an impact tool configured to only linearly drive a tool accessory.

BACKGROUND ART

An impact tool (such as an electric hammer (also called as a scraper)) is known which is configured to perform a chipping operation or a scraping operation only by linearly driving a tool accessory. Such an impact tool may include a lock mechanism which is configured to lock an operation member for a switch for driving a tool accessory in a position in which the operation member places the switch in an ON state (see Japanese laid-open patent publication No. 2008-119755, for example).

SUMMARY

Such an impact tool having a lock mechanism as described above eliminates the need for a user to keep pressing the operation member during the chipping or scraping operation so that the convenience is improved. Such an impact tool is, however, desired to further improve the convenience.

It is, accordingly, an object of the present disclosure to provide a technique which helps improve convenience in an impact tool configured to only linearly drive a tool accessory.

According to one aspect of the present disclosure, an impact tool is provided which is configured to only linearly drive a tool accessory along a drive axis extending in a front-rear direction. The impact tool includes a switch, an operation member, a first lock member, a second lock member and a holding mechanism. The switch is for driving the tool accessory. The operation member is configured to be movable between an OFF position and an ON position. The operation member in the OFF position holds the switch in an OFF state, and the operation member in the ON position holds the switch in an ON state. The first lock member is configured to lock the operation member in the ON position. The second lock member is configured to be movable between a lock position and a lock-release position, in response to an external operation by a user. The second lock member in the lock position is capable of locking the operation member in the OFF position. The second lock member in the lock-release position is incapable of locking the operation member in the OFF position. The holding mechanism is configured to hold the second lock member in the lock position and also in the lock-release position.

In one aspect of the present disclosure, the impact tool may further include a grip part extending in an up-down direction orthogonal to the drive axis. The operation member may be provided on the grip part, and the second lock member may be disposed on an upper side of the grip part.

In one aspect of the present disclosure, the second lock member may be movable between the lock position and the lock-release position in a direction crossing a moving direction of the operation member.

In one aspect of the present disclosure, the holding mechanism may include a biasing member. Further, the holding mechanism may be configured to hold the second lock member in the lock position and also in the lock-release position by a biasing force of the biasing member.

In one aspect of the present disclosure, both end portions of the second lock member in a moving direction of the second lock member may be disposed to be externally operated by a user. Further, the end portions of the second lock member may have different structures.

In one aspect of the present disclosure, a single lock member may be configured to serve both as the first lock member and the second lock member. In other words, the single lock member may have both the function of locking the operation member in the ON position and the function of locking the operation member in the OFF position.

In one aspect of the present disclosure, the lock member may be capable of locking the operation member both in the ON position and in the OFF position when the lock member is in the lock position. Further, the lock member may be configured to allow the operation member to move between the OFF position and the ON position when the lock member is in the lock-release position.

In one aspect of the present disclosure, the operation member may include a first interference part, and the lock member may include a second interference part. The second interference part may be configured to be placed on a moving path of the first interference part when the lock member is in the lock position to thereby lock the operation member in the ON position or in the OFF position by interfering with the first interference part. The second interference part may have an outer surface which includes opposed first and second surfaces arranged to cross a moving direction of the operation member. The first surface which is arranged on the ON position side of the second interference part in the moving direction may be configured to lock the operation member in the ON position by abutting on the first interference part. Further, the second surface which is arranged on the OFF position side of the second interference part in the moving direction may be configured to lock the operation member in the OFF position by abutting on the first interference part. It is noted that the terms "the ON position side in the moving direction" and "the OFF position side in the moving direction" may be rephrased more specifically as "the side to which the operation member is moved from the OFF position toward the ON position in the moving direction" and "the side to which the operation member is moved from the ON position toward the OFF position in the moving direction".

In one aspect of the present disclosure, the first interference part may include at least one projection protruding toward the lock member. Further, the second interference part may include at least one projection protruding toward the operation member.

In one aspect of the present disclosure, the lock member may be movable from the lock-release position in a first direction and a second direction which is different from the first direction. The lock member may be configured to serve as the first lock member to lock the operation member in the ON position when moved from the lock-release position to a specified position in the first direction, and to serve as the second lock member to lock the operation member in the OFF position when moved from the lock-release position to the lock position in the second direction.

In one aspect of the present disclosure, the lock member may be movable in a direction orthogonal to the drive axis. Further, the first direction and the second direction may be opposite to each other.

In one aspect of the present disclosure, the holding mechanism may be configured to hold the lock member in the specified position, the lock position and the lock-release position.

In one aspect of the present disclosure, the operation member may include a first interference part. The lock member may include a second interference part. The second interference part may include an ON-lock part and an OFF-lock part. The ON-lock part may be configured to lock the operation member in the ON position by abutting on the first interference part on the OFF position side of the first interference part when the lock member is in the specified position. The OFF-lock part may be configured to lock the operation member in the OFF position by abutting on the first interference part on the ON position side of the first interference part when the lock member is in the lock position.

In one aspect of the present disclosure, the first interference part may include at least one projection protruding toward the lock member. Further, the second interference part may include at least one projection protruding toward the operation member.

In one aspect of the present disclosure, the operation member may be configured to restrict a movement of the lock member from the lock-release position in the first direction when the operation member is in the OFF position. The operation member may be further configured to restrict a movement of the lock member from the lock-release position in the second direction when the operation member is in the ON position.

In one aspect of the present disclosure, the operation member may be provided in a front portion of the grip part so as to be movable in the front-rear direction. The lock member may be movable in a direction crossing the front-rear direction. The lock member may include a first abutment part and a second abutment part. The first and second abutment parts may be arranged at different positions in the front-rear direction and spaced apart from each other in a moving direction of the lock member. The first abutment part may be arranged forward of the second abutment part. Further, the operation member may be configured to abut on the first abutment part when the operation member is in the OFF position, thereby restricting the movement of the lock member in the first direction, and to abut on the second abutment part when the operation member is in the ON position, thereby restricting the movement of the lock member in the second direction.

In one aspect of the present disclosure, each of the first and second abutment parts may be a projection protruding toward the operation member.

In one aspect of the present disclosure, the operation member may include a receiving part configured to abut on the first abutment part and on the second abutment part. The first abutment part my be configured to lock the operation member in the ON position by abutting on a front surface of the receiving part when the lock member is in the specified position. Further, the second abutment part may be configured to lock the operation member in the OFF position by abutting on a rear surface of the receiving part when the lock member is in the lock position.

In one aspect of the present disclosure, the receiving part may include at least one projection protruding toward the lock member.

In one aspect of the present disclosure, the impact tool may further include a battery-mounting part which is configured to removably receive a rechargeable battery.

DETAILED DESCRIPTION OF THE EMBODIMENTS

An embodiment is now described with reference to the drawings. In the present embodiment, an electric hammer (also called as a scraper) 1 is described as an example. The electric hammer 1 is an example of an impact tool which is configured to only linearly drive a tool accessory 91 along a specified drive axis A1. The electric hammer 1 may be used for a chipping operation or a scraping operation (surface preparation).

Figure 1:
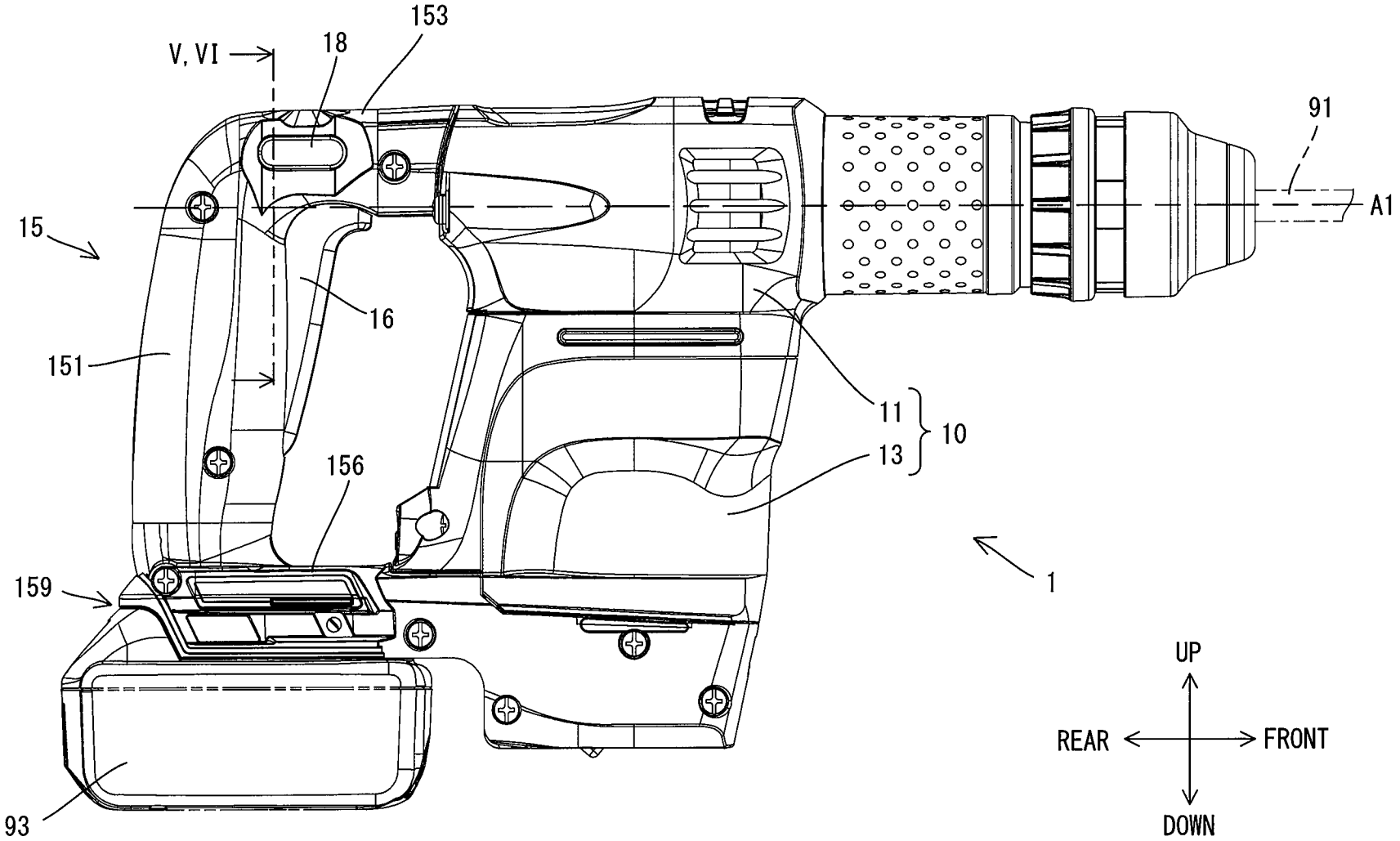
FIG. 1 is a right side view showing an electric hammer.
Figure 2:
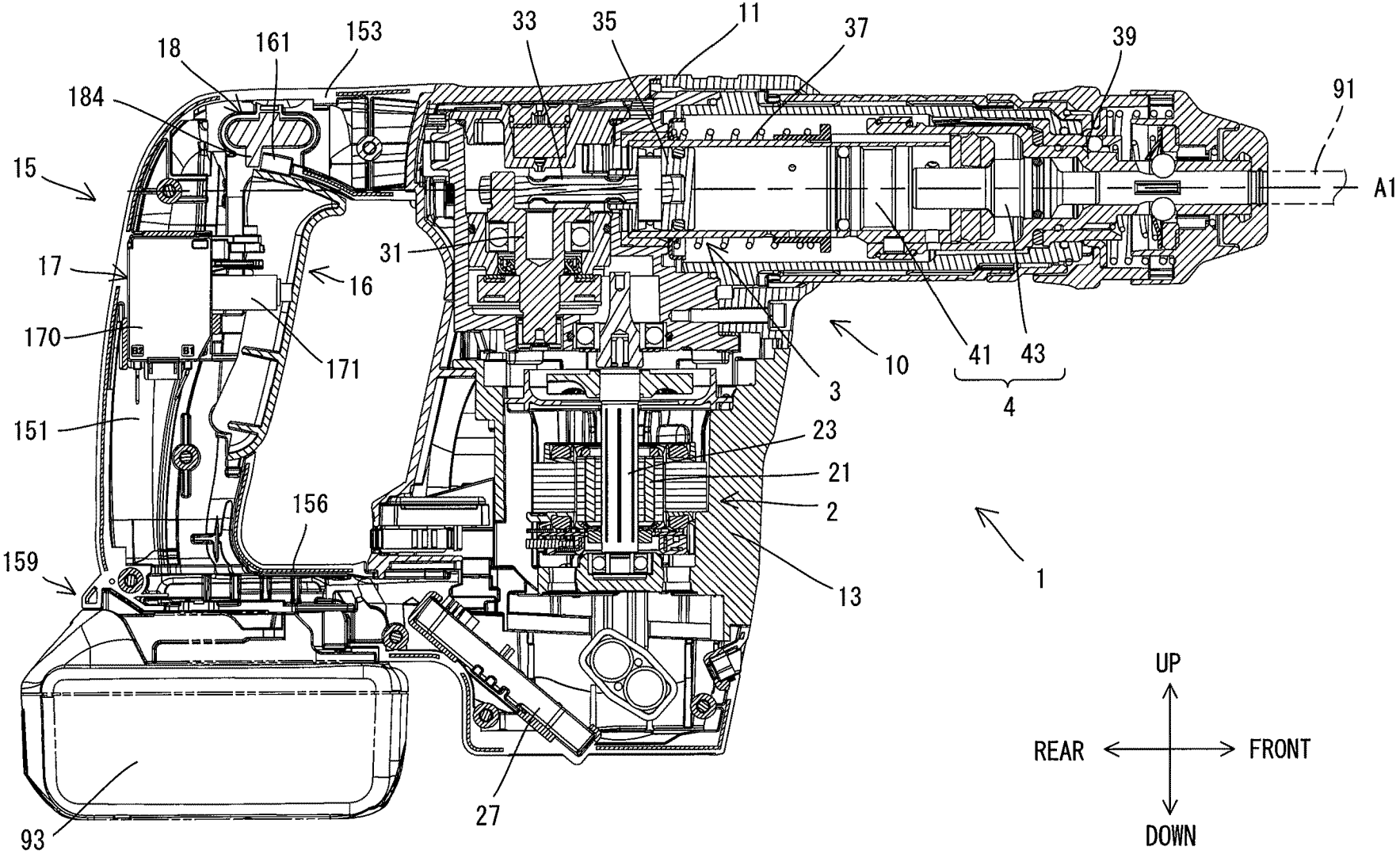
FIG. 2 is a sectional view of the electric hammer.

First, the general structure of the electric hammer 1 is described. As shown in FIGS. 1 and 2, an outer shell of the electric hammer 1 is mainly formed by a body housing 10 and a handle 15.

The body housing 10 is generally L-shaped and includes a driving-mechanism-housing part 11 and a motor-housing part 13. The driving-mechanism-housing part 11 extends along the drive axis A1. A tool holder 39 to which the tool accessory 91 may be removably coupled is provided in one axial end portion of the driving-mechanism-housing part 11 in a direction of the drive axis A1. The motor-housing part 13 is connected to the other axial end portion of the driving-mechanism-housing part 11 on the side opposite to the tool holder 39. The motor-housing part 13 extends in a direction crossing (more specifically, generally orthogonal to) the drive axis A1. The driving-mechanism-housing part 11 houses a motion-converting mechanism 3 and a striking mechanism 4, which will be described later. The motor-housing part 13 houses a motor 2.

In the following description, for convenience sake, the extending direction of the drive axis A1 of the electric hammer 1 (hereinafter also referred to as a drive-axis-A1 direction) is defined as a front-rear direction of the electric hammer 1. In the front-rear direction, the side of the one axial end portion of the electric hammer 1 in which the tool holder 39 is disposed is defined as a front side (or a front end region side) of the electric hammer 1 and the opposite side is defined as a rear side. Further, a direction orthogonal to the drive axis A1 and corresponding to the extending direction of the motor-housing part 13 is defined as an up-down direction of the electric hammer 1. In the up-down direction, a direction toward which the motor-housing part 13 protrudes from the driving-mechanism-housing part 11 is defined as a downward direction and the opposite direction is defined as an upward direction. A direction orthogonal to the front-rear direction and the up-down direction is defined as a left-right direction.

The handle 15 is generally C-shaped and includes a grip part 151 and connection parts 153, 156. The grip part 151 is an elongate portion to be held by a user and extends in the up-down direction behind the body housing 10. A trigger 16 which can be depressed by the user is provided on a front portion of the grip part 151. The connection parts 153, 156 protrude forward from upper and lower end portions of the grip part 151, respectively, and are connected to a rear end portion of the body housing 10. A battery-mounting part 159, which is configured to removably receive a rechargeable battery 93, is provided on a lower end portion of the lower connection part 156. The structure of the battery-mounting part 159 is well known and therefore not described in detail here.

The structure of the electric hammer 1 is now described in detail.

First, the internal structure of the body housing 10 is described. As shown in FIG. 2, the motor 2 is housed in a central portion of the motor-housing part 12 of the body housing 10. In the present embodiment, a direct current (DC) brushless motor is employed as the motor 2. The motor 2 is arranged such that a motor shaft 23 which rotates together with a rotor 21 extends in the up-down direction, orthogonal to the drive axis A1. A controller 27 which is configured to control driving of the motor 2 is housed in a lower end portion of the motor-housing part 13.

Further, the motion-converting mechanism 3 is housed in a rear portion of the driving-mechanism-housing part 11, and the striking mechanism 4 is housed in a front portion of the driving-mechanism-housing part 11. The motion-converting mechanism 3 is configured to convert rotation of the motor shaft 23 into linear motion and transmit it to the striking mechanism 4. In the present embodiment, the motion-converting mechanism 3 is configured as a crank mechanism including a crank shaft 31, a connecting rod 33, a piston 35 and a cylinder 37. The striking mechanism 4 is configured to apply striking force to the tool accessory 91 in the drive-axis-A1 direction. In the present embodiment, the striking mechanism 4 includes a striker 41 and an impact bolt 43. The structures of the motion-converting mechanism (crank mechanism) 3 and the striking mechanism 4 are well known and therefore not described in detail here.

When the motor 2 is driven and the piston 35 is moved forward within the cylinder 37, air in an air chamber formed between the piston 35 and the striker 41 is compressed so that the internal pressure increases. Therefore, the striker 41 is pushed forward at high speed by the action of an air spring and collides with the impact bolt 43, thereby transmitting its kinetic energy to the tool accessory 91. As a result, the tool accessory 91 is linearly driven along the drive axis A1 and strikes a workpiece. On the other hand, when the piston 35 is moved rearward, the air in the air chamber expands so that the internal pressure decreases and the striker 41 is retracted rearward. The chipping or scraping operation (surface preparation) may be performed while such operations of the motion-converting mechanism 30 and the striking mechanism are repeated.

The internal structure of the handle 15 is now described. As shown in FIG. 2, the trigger 16 is provided on the front portion of the grip part 151 of the handle 15. In the present embodiment, the trigger 16 is configured as an elongate lever extending in the up-down direction. The trigger 16 is supported by the grip part 151 so as to be pivotable generally in the front-rear direction. More specifically, the trigger 16 is pivotable between a frontmost position shown in FIG. 3 and a rearmost position shown in FIG. 4, around a lower end portion of the trigger 16. The trigger 16 has a projection 161 protruding upward from its upper end portion. In the present embodiment, two such projections 161 are provided apart from each other in the left-right direction (see FIG. 5). Each of the projections 161 has a rectangular block-like shape having a front surface 162 and a rear surface 163. The front surface 162 and the rear surface 163 are surfaces which are generally orthogonal to the moving direction of the trigger 16, and are opposed to each other in the moving direction. The projection 161 is configured to be engageable with a lock member 18 (specifically, with a projection 184), which will be described in detail later.

As shown in FIG. 2, a switch 17 for energizing the motor 2 (in other words, for driving the tool accessory 91) is housed within the grip part 151. The trigger 16 is normally (in a non-depressed state) biased forward by a plunger 171 which protrudes from a body 170 of the switch 17, and held in the frontmost position (shown in FIG. 3) within a pivot range of the trigger 16. In the frontmost position, the front surface 162 of the projection 161 is in abutment with a rear end of a lower wall of the connection part 153, and the switch 17 is in an OFF state. When the trigger 16 is depressed and turned rearward to a specific position (also referred to as a switching position) within the pivot range, the plunger 171 is pushed into the body 170 and the switch 17 is placed in an ON state. When the switch 17 is in the ON state, the motor 2 is energized and the tool accessory 91 is driven.

In the present embodiment, the rearmost position (shown in FIG. 4) of the trigger 16 in the pivot range is set slightly rearward of the switching position. Therefore, the switch 17 is held in the OFF state when the trigger 16 is located within a range (excluding the switching position) between the frontmost position and the switching position, and the switch 17 is held in the ON state when the trigger 16 is located within a range (including the switching position) between the switching position and the rearmost position. In the following description, the position of the trigger 16 (between the frontmost position and the switching position) to place the switch 17 in the OFF state is referred to as an OFF position, and the position of the trigger 16 (between the switching position and the rearmost position) to place the switch 17 in the ON state is referred to as an ON position.

As shown in FIG. 2, a lock member 18 is provided in the upper connection part 153 of the handle 15. The lock member 18 of the present embodiment has a function of locking the trigger 16 in the OFF position (also referred to as a trigger-lock function) and a function of locking the trigger 16 in the ON position (also referred to as an on-lock function). The function of locking the trigger 16 in the OFF position can also be rephrased as a function of restricting the trigger 16 from moving to the ON position. The manner of restricting the trigger 16 from moving to the ON position includes not only the manner of completely preventing the movement from the OFF position, but the manner of preventing the movement up to the ON position while allowing a slight movement from the OFF position. Similarly, the function of locking the trigger 16 in the ON position can also be rephrased as a function of restricting the trigger 16 from moving to the OFF position. The manner of restricting the trigger 16 from moving to the OFF position includes not only the manner of completely preventing the movement from the ON position, but the manner of preventing the movement up to the OFF position while allowing a slight movement from the ON position.

Figure 5:
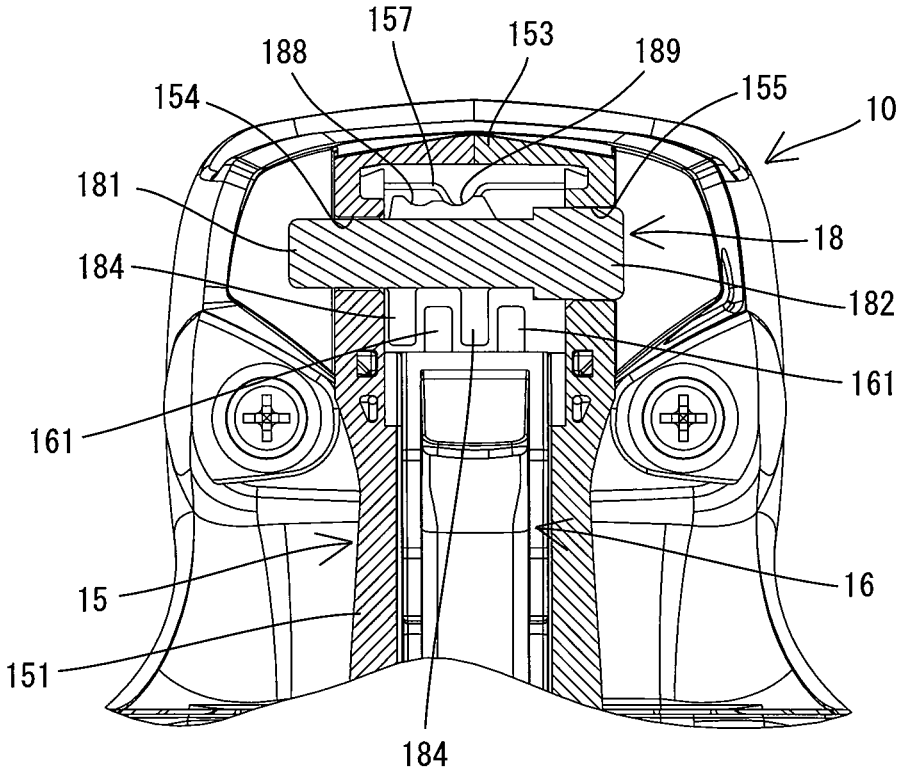
FIG. 5 is a sectional view taken along line V-V in FIG. 1 when the lock member is placed in a lock-release position.
Figure 6:
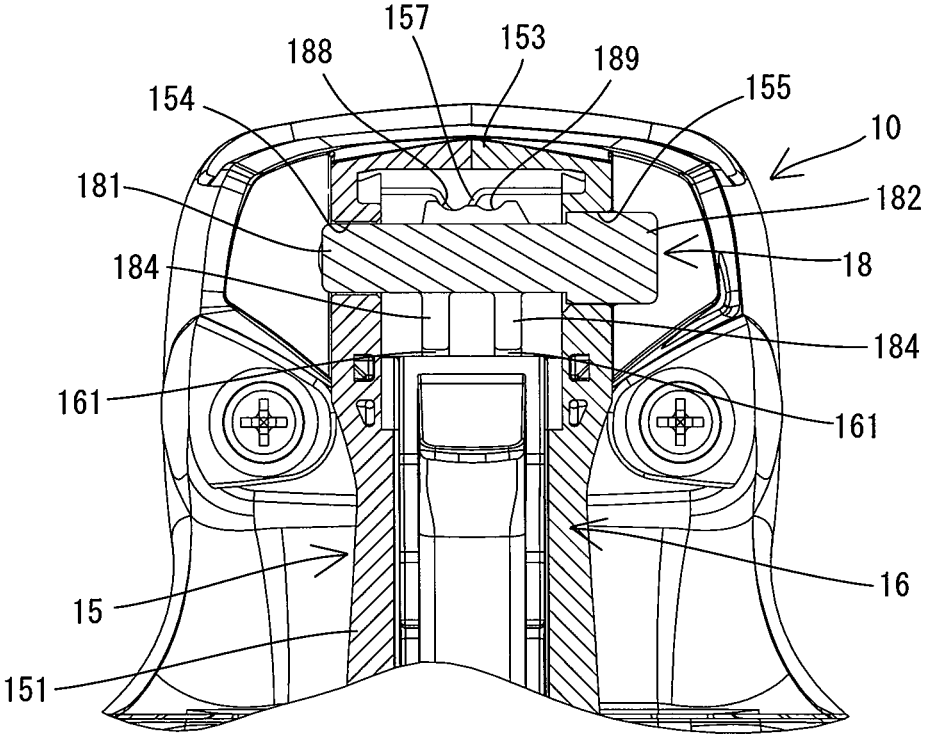
FIG. 6 is a sectional view taken along line VI-VI in FIG. 1 when the lock member is placed in a lock position.

The structure of the lock member 18 is now described in detail. In the present embodiment, as shown in FIG. 2, the lock member 18 is a rod-like member having a generally elliptical section. The lock member 18 is supported above the trigger 16 by the connection part 153 so as to be movable in the left-right direction. More specifically, as shown in FIGS. 5 and 6, through holes 154 and 155 are formed in left and right walls of the connection part 153, respectively. Left and right end parts 181, 182 of the lock member 18 are respectively inserted through the through holes 154, 155 so that the lock member 18 is supported to be slidable in the left-right direction. The right end part 182 of the lock member 18 has a different structure from the left end part 181. Specifically, the right end part 182 is configured as a large-diameter part having a slightly larger diameter than the left end part 181. Correspondingly, the through hole 155 is formed slightly larger than the through hole 154. The left and right end parts 181, 182 are at least partially exposed to the outside from the connection part 153 through the through holes 154, 155, respectively, and serve as operation parts to be pushed rightward or leftward by the user.

Figure 3:
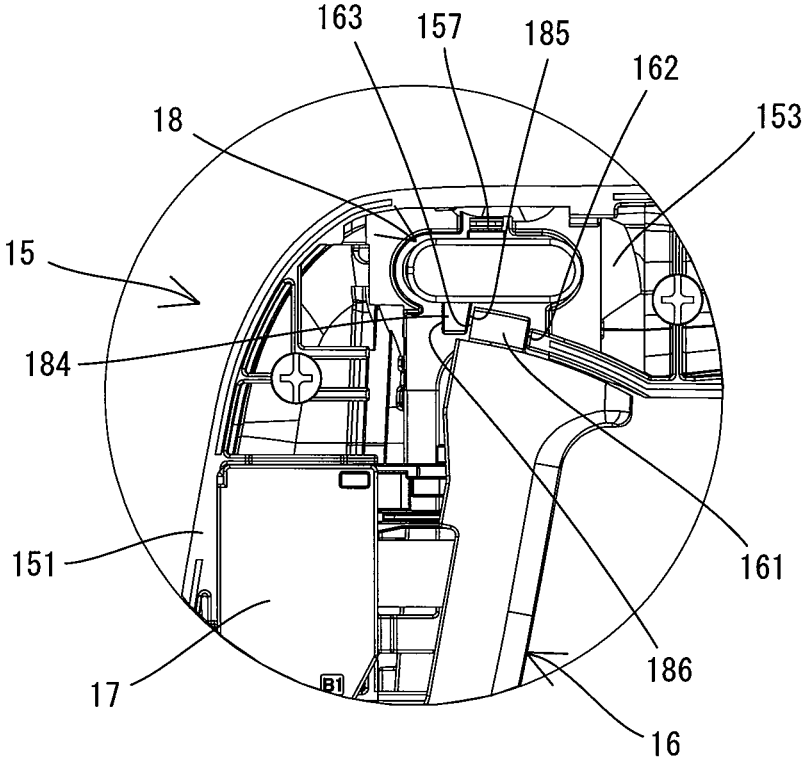
FIG. 3 is a right side view showing a lock member and a trigger placed in a frontmost position.

A projection 184 is provided to protrude downward from a lower end of the lock member 18. In the present embodiment, there are two such projections 184 which are respectively engageable with the two projections 161 of the trigger 16. The two projections 184 are arranged apart from each other in the left-right direction, with a spacing which is larger than the width of the projection 161 of the trigger 16 in the left-right direction. The spacing between the projections 161 of the trigger 16 in the left-right direction is also larger than the width of the projection 184 of the lock member 18 in the left-right direction. The width of the projection 184 in the left-right direction is generally equal to the width of the projection 161 in the left-right direction. Further, the projection 184 has a rectangular block-like shape having a front surface 185 and a rear surface 186, as shown in FIG. 3. The front surface 185 and the rear surface 186 are generally orthogonal to the moving direction of the trigger 16 and opposed to each other in the moving direction.

Further, as shown in FIGS. 5 and 6, a projection is provided to protrude upward on a central upper end portion of the lock member 18. The projection has two recesses recessed downward and arranged side by side in the left-right direction. The left recess and the right recess are hereinafter referred to as a first recess 188 and a second recess 189, respectively. Further, a flat spring 157 is disposed within the connection part 153 such that the flat spring 157 is opposed to the lock member 18 from above. A generally central portion of the flat spring 157 is formed as a protruding portion protruding downward. The flat spring 157 may be snap-engaged with the first recess 188 or the second recess 189 via this protruding portion, thereby holding the lock member 18 in a specified position (where the protruding portion is engaged with the first recess 188 or with the second recess 189), thereby restricting the lock member 18 from sliding relative to the connection part 153 in the left-right direction. Thus, even if the lock member 18 is released after once pushed to move by the user, the lock member 18 does not automatically return to an initial position. The user can move the lock member 18 rightward or leftward from the specified position against the biasing force of the flat spring 157 by pushing the left end part 181 rightward, or by pushing the right end part 182 leftward.

The trigger-lock function and the on-lock function of the lock member 18 are now described.

Figure 7:
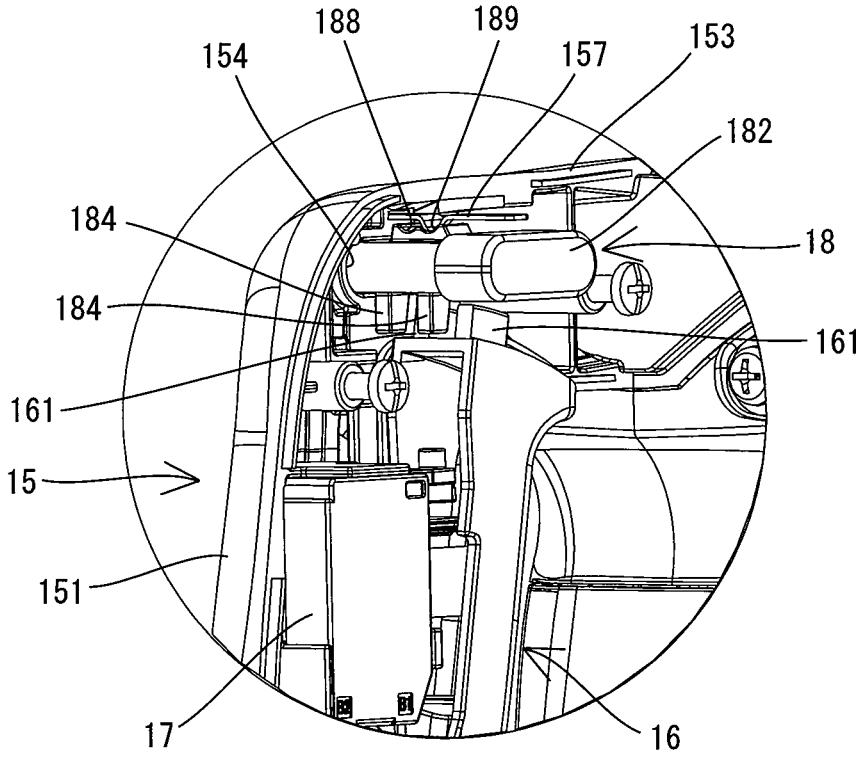
FIG. 7 is a perspective view showing the lock member placed in the lock-release position and the trigger placed in the frontmost position as viewed obliquely from behind.
Figure 8:
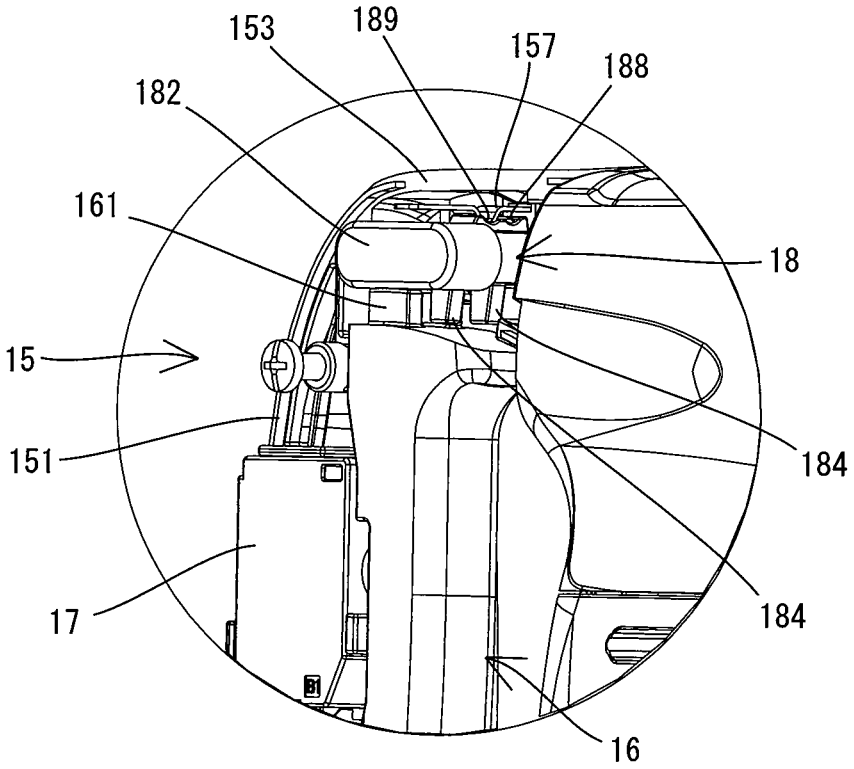
FIG. 8 is a perspective view showing the lock member placed in the lock-release position and the trigger placed in the rearmost position as viewed obliquely from the front.

As shown in FIG. 5, when the right end part (large-diameter part) 182 is pushed leftward and the lock member 18 is placed in a position in which the flat spring 157 is engaged with the second recess (right recess) 189, the left end part 181 protrudes leftward from the connection part 153. At this time, the two projections 184 of the lock member 18 are disposed in positions respectively deviated leftward from moving paths of the two projections 161 of the trigger 16 which is movable between the frontmost position (see FIG. 3) and the rearmost position (see FIG. 4). In other words, the lock member 18 is disposed in a position in which the projections 161 do not interfere with the projections 184 in the process of movement of the trigger 16 between the frontmost position and the rearmost position. Therefore, by depressing the trigger 16 placed in the frontmost position as shown in FIG. 7, the user can move the trigger 16 rearward up to the rearmost position as shown in FIG. 8. When the user releases the trigger 16, the trigger 16 is biased forward by the plunger 171 and returned to the frontmost position shown in FIG. 7.

In this manner, when the lock member 18 is placed in a position in which the protruding portion of the flat spring 157 is engaged with the second recess 189, the lock member 18 allows the trigger 16 to move between the frontmost position and the rearmost position and cannot lock the trigger 16 in the ON position or in the OFF position. Accordingly, the position of the lock member 18 in which the protruding portion of the flat spring 157 is engaged with the second recess 189 is also referred to as a lock-release position.

As shown in FIG. 6, when the left end part 181 is pushed rightward and the lock member 18 is disposed in a position in which the flat spring 157 is engaged with the first recess (left recess) 188, the right end part 182 protrudes rightward from the connection part 153. At this time, the two projections 184 of the lock member 18 are disposed on the moving paths of the two projections 161 of the trigger 16. In other words, the lock member 18 is disposed in a position in which the projections 161 interfere with the projections 184 in the process of movement of the trigger 16 between the frontmost position and the rearmost position.

Figure 9:
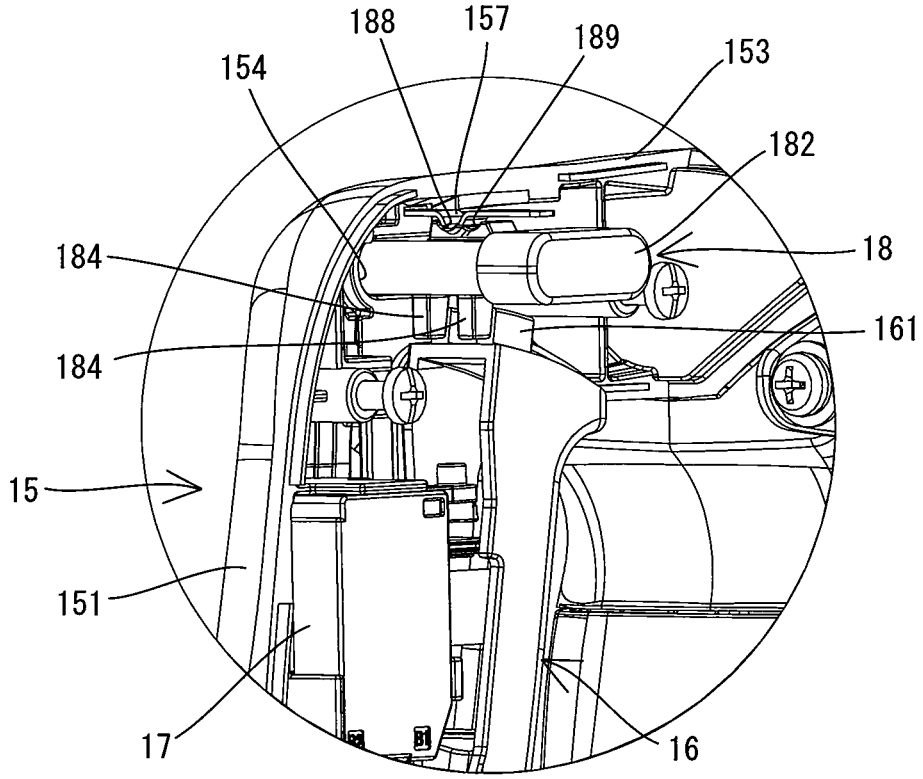
FIG. 9 is a perspective view showing the trigger locked in an OFF position by the lock member placed in the lock position as viewed obliquely from behind.

As shown in FIG. 3, when the lock member 18 is placed in this position while the trigger 16 is located in the frontmost position, the projections 184 are located slightly rearward of the projections 161 of the trigger 16. In this state, when the user depresses the trigger 16, as shown in FIG. 9, the rear surfaces 163 (see FIG. 3) of the projections 161 of the trigger 16 abut on the front surfaces 185 (see FIG. 3) of the respective projections 184 of the lock member 18, so that the trigger 16 is prevented from further moving rearward. At this time, the trigger 16 is in the OFF position. In other words, the lock member 18 locks the trigger 16 in the OFF position (performs the trigger-lock function) through engagement (abutment) between the projections 184 and 161. Therefore, unless moving the lock member 18 to the above-described lock-release position (see FIG. 5), the user cannot depress the trigger 16 and thus cannot cause the tool accessory 91 to be driven.

Figure 4:
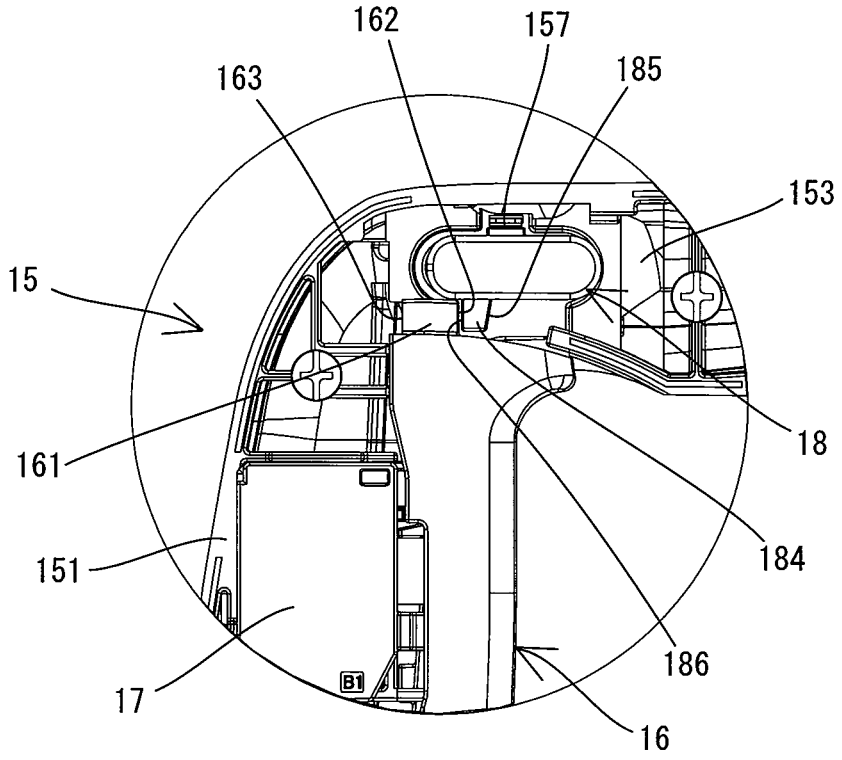
FIG. 4 is a right side view showing the lock member and the trigger placed in a rearmost position.
Figure 10:
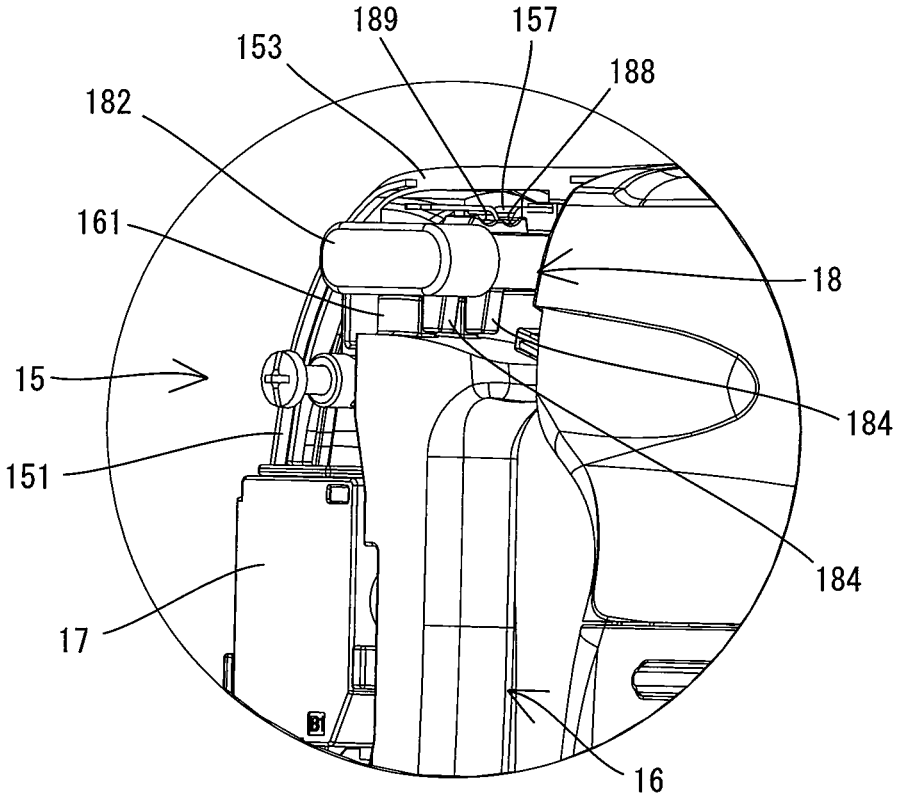
FIG. 10 is a perspective view showing the trigger locked in an ON position by the lock member placed in the lock position as viewed obliquely from the front.

When the lock member 18 is disposed in the lock-release position (see FIG. 5) and thereafter, as shown in FIG. 4, moved to the position in which the flat spring 157 is engaged with the first recess 188 while the trigger 16 is depressed to be placed in the rearmost position, the projections 184 are located slightly forward of the projections 161 of the trigger 16. In this state, when the user releases the trigger 16, the trigger 16 is biased forward by the plunger 171. As shown in FIG. 10, however, the front surfaces 162 (see FIG. 3) of the projections 161 abut on the rear surfaces 186 (see FIG. 3) of the respective projections 184, so that the trigger 16 is prevented from further moving forward. At this time, the trigger 16 is in the ON position. In other words, the lock member 18 locks the trigger 16 in the ON position (performs the on-lock function) through engagement (abutment) between the projections 184 and 161. Therefore, even if the user releases the trigger 16, the switch 17 is kept in the ON state and the tool accessory 91 is kept driven. Unless moving the lock member 18 to the above-described lock-release position (see FIG. 5), the user cannot return the trigger 16 to the OFF position and stop driving of the tool accessory 91.

In this manner, when the lock member 18 is placed in a position in which the protruding portion of the flat spring 157 is engaged with the first recess 188, the lock member 18 can lock the trigger 16 in the ON position or in the OFF position. Accordingly, the position of the lock member 18 in which the protruding portion of the flat spring 157 is engaged with the first recess 188 is also referred to as a lock position.

As described above, the electric hammer 1 of the present embodiment includes the lock member 18 having both the on-lock function and the trigger-lock function. Therefore, when the user wants to keep driving the tool accessory 91 for a while, the user can lock the trigger 16 in the ON position with the lock member 18, thereby eliminating the need for troublesome operation of keeping depressing the trigger 16. Further, for example, when the operation is suspended for a while, the user can lock the trigger 16 in the OFF position with the lock member 18, thereby preventing the tool accessory 91 from being unintentionally driven. Particularly, the electric hammer 1 of the present embodiment may be carried or stored with the battery (power source) 93 left mounted thereto. Therefore, by locking the trigger 16 in the OFF position with the lock member 18 when carrying or storing the electric hammer 1, the tool accessory 91 can be prevented from being unintentionally driven due to some cause.

Further, in the present embodiment, the flat spring 157 is provided which is configured to hold the lock member 18 in the lock position and also in the lock-release position. Therefore, even if the external operation of the lock member 18 is released by the user after the lock member 18 is placed in the lock-release position, the lock member 18 is held in the lock-release position by the flat spring 157 and does not automatically return to the lock position. Similarly, even if the external operation of the lock member 18 is released by the user after the lock member 18 is placed in the lock position, the lock member 18 does not automatically return to the lock-release position. The lock of the trigger 16 can be released only by moving the lock member 18 to the lock-release position, regardless of an operation of the trigger 16.

Therefore, for example, when moving the trigger 16 locked in the OFF position to the ON position, the user need not perform a troublesome two-action operation of holding the lock member 18 in the lock-release position and moving the trigger 16 to the ON position at the same time. In other words, once moving the lock member 18 to the lock-release position, the user can cause the tool accessory 91 to be driven in one action (only by depressing the trigger 16). In the chipping or scraping operation, the user may operate the trigger 16 to drive the tool accessory 91 while shifting the machining position little by little. In such a case, the user may need to repeat the operations of depressing and releasing the trigger 16 at short intervals. The lock member 18 of the present embodiment, however, does not require the two-action operation for each depressing operation of the trigger 16, so that work efficiency and convenience can be improved.

Further, the user can easily switch the position of the lock member 18 simply by moving the lock member 18 against the biasing force of the flat spring 157 since the lock member 18 is held in the lock position or in the lock-release position only by the biasing force of the flat spring 157.

Further, in the present embodiment, the trigger 16 is provided on the grip part 151 extending in the up-down direction orthogonal to the drive axis A1, and the lock member 18 is disposed on the upper side of the grip part 151. In other words, the lock member 18 and the trigger 16 are provided in different portions, but relatively close to each other. Thus, the structure for locking the trigger 16 can be realized in a relatively compact structure, utilizing engagement between the projections 161 and 184.

Further, in the present embodiment, the lock member 18 can be moved in a direction crossing the moving direction of the trigger 16 between the lock position, in which the lock member 18 is capable of locking the trigger 16 in the OFF position, and the lock-release position, in which the lock member 18 is incapable of locking the trigger 16 in the OFF position, in response to the external operation by the user. Specifically, the lock member 18 can be moved in the left-right direction between the lock position and the lock-release position, while the trigger 16 can be moved in the generally left-right direction. The moving directions of the trigger 16 and the lock member 18 correspond to the respective operating directions. Therefore, the user can easily lock the trigger 16 in the OFF position and release the lock by moving the lock member 18. Further, when operating one of the trigger 16 and the lock member 18, the user can be prevented from mistakenly operating the other since the operating directions of the trigger 16 and the lock member 18 are different from each other.

In the present embodiment, the both end portions of the lock member 18 in the moving direction (i.e. the left-right direction) are disposed to be externally operated by the user and have different structures. Specifically, the right end part 182 which is pushed to release the lock of the trigger 16 has a larger diameter than the left end part 181 which is pushed to lock the trigger 16 in the ON position or in the OFF position. Therefore, the user can easily recognize which one of the left and right end parts 181, 182 should be operated when moving the lock member 18 to the lock position or to the lock-release position.

In the present embodiment, the single lock member 18 has both the on-lock function of locking the trigger 16 in the ON position and the trigger-lock function of locking the trigger 16 in the OFF position. Therefore, both of the functions are realized in a more compact and simpler structure than in a structure using two separate lock members. Further, in the present embodiment, the lock member 18 performs the on-lock function and the trigger-lock function by interference of the projections 184 with the projections 161 of the trigger 16 on the moving paths of the projections 161 when the lock member 18 is in the lock position. Specifically, the rear surface 186 (on the ON position side (rear side)) and the front surface 185 (on the OFF position side (front side)) of the projection 184, which are opposed to each other and arranged to cross the moving direction of the trigger 16, lock the trigger 16 respectively in the ON position and in the OFF position by abutting on the projection 161. Thus, the lock member 18 is capable of performing the on-lock function or the trigger-lock function in the same position (in the lock position), depending on which one of the rear surface 186 and the front surface 185 of the projection 184 abuts on the projection 161. In this manner, the lock member 18 which is capable of performing the both functions is realized in a compact, simple and easy-to-operate structure.

Correspondences between the features of the embodiment and the features of the disclosure are as follows. The electric hammer 1 is an example that corresponds to the "impact tool". The drive axis A1 is an example that corresponds to the "drive axis". The switch 17 is an example that corresponds to the "switch". The trigger 16 is an example that corresponds to the "operation member". The lock member 18 is an example that corresponds to each of the "first lock member", the "second lock member" and the "single lock member". The grip part 151 is an example that corresponds to the "grip part". The flat spring 157 and the first and second recesses 188, 189 as a whole is an example that corresponds to the "holding mechanism". Each of the projections 161 of the trigger 16 is an example that corresponds to the "first interference part". Each of the projections 184 of the lock member 18 is an example that corresponds to the "second interference part". The rear surface 186 and the front surface 185 of the projection 184 are examples that correspond to the "first surface" and the "second surface", respectively. The battery-mounting part 159 is an example that corresponds to the "battery-mounting part".

The above-described embodiment is a mere example and an impact tool according to the present disclosure is not limited to the structure of the electric hammer 1 of the above-described embodiment. For example, the following modifications may be made. Further, one or more of these modifications may be employed in combination with the electric hammer 1 of the above-described embodiment or the claimed invention.

For example, the on-lock function of locking the trigger 16 in the ON position and the trigger-lock function of locking the trigger 16 in the OFF position may be realized by a plurality of separate lock members in place of the single lock member 18. In this case, for example, two lock members, each of which, like the lock member 18, can be moved in the left-right direction between the lock position and the lock-release position, may be provided respectively corresponding to the ON position and the OFF position of the trigger 16. Alternatively, two lock members may be provided to be movable in different directions from each other between the lock position and the lock-release position.

In the above-described embodiment, the lock member 18 can lock the trigger 16 in the ON position and in the OFF position when placed in the same lock position, while allowing the trigger 16 to move from the ON position to the OFF position as well as from the OFF position to the ON position when placed in the same lock-release position. Even when using the single lock member 18 to realize the on-lock function and the trigger-lock function, however, a lock position for locking the trigger 16 in the ON position and a lock position for locking the trigger 16 in the OFF position may be different from each other. Similarly, a lock-release position for allowing the trigger 16 to move from the ON position to the OFF position and a lock-release position for allowing the trigger 16 to move from the OFF position to the ON position may be different from each other.

As an example of such a modification, with reference to FIGS. 11 to 15, a lock member 19 is now described. The lock member 19 has different lock positions for locking the trigger 16 in the ON position and for locking the trigger 16 in the OFF position, and has a common lock-release position. In the present modification, the body housing 10, the handle 15 and the trigger 16 are slightly different in shape from those of the above-described embodiment, but substantially have the same structures. Accordingly, in the following description and the drawings to be referred, components having substantially the same structures are given the same numerals, and are not described or only briefly described.

Figure 11:
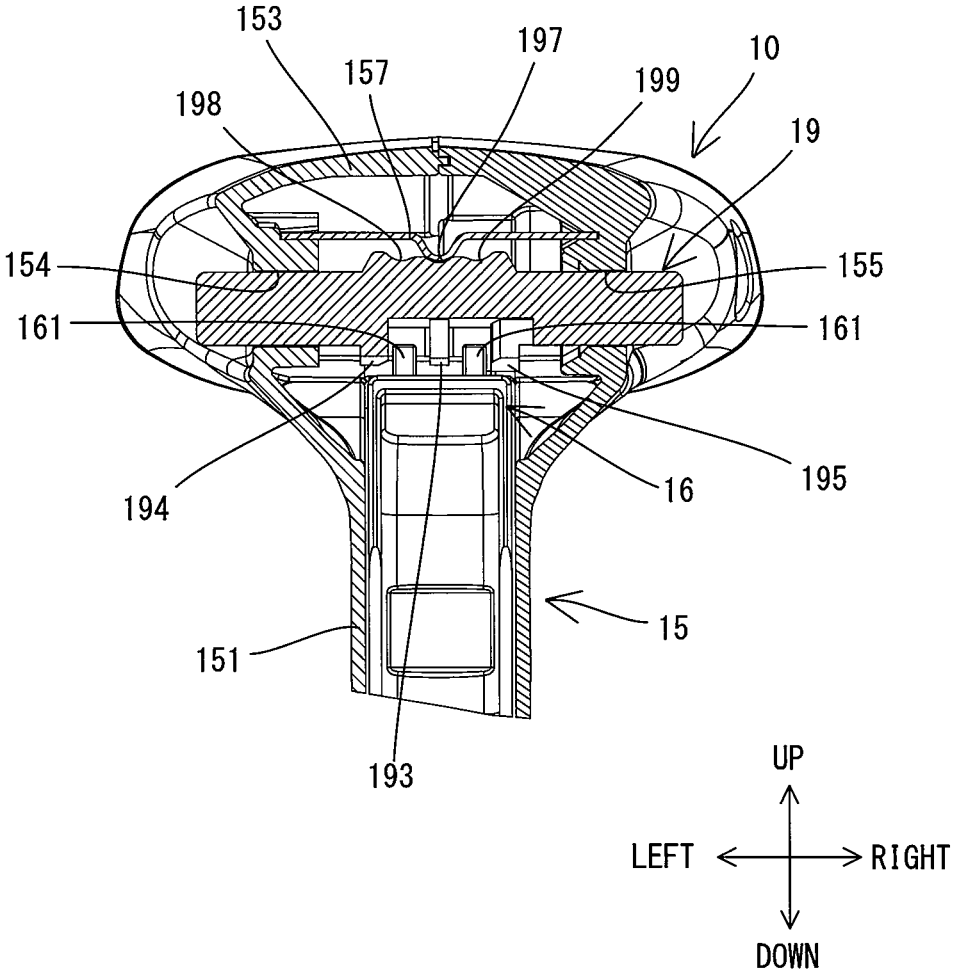
FIG. 11 is a sectional view corresponding to FIG. 5, showing a lock member placed in a lock-release position according to a modification.

As shown in FIG. 11, like the lock member 18 of the above-described embodiment, the lock member 19 of the present modification is a rod-like member. The lock member 19 is supported above the trigger 16 by the connection part 153 so as to be movable in the left-right direction, while left and right end portions of the lock member 19 are respectively inserted through the through holes 154, 155. Further, unlike the lock member 18, the left and right end portions of the lock member 19 have the same shape.

Further, in the present modification, three projections are provided to protrude downward from the lower end portion of the lock member 19. The three projections have generally the same protruding length. The three projections are spaced apart from each other in the left-right direction, and each of the distances between adjacent two projections is larger than the width of the projection 161 of the trigger 16 in the left-right direction. The central, left and right projections are hereinafter referred to as a first projection 193, a second projection 194 and a third projection 195, respectively.

Figure 12:
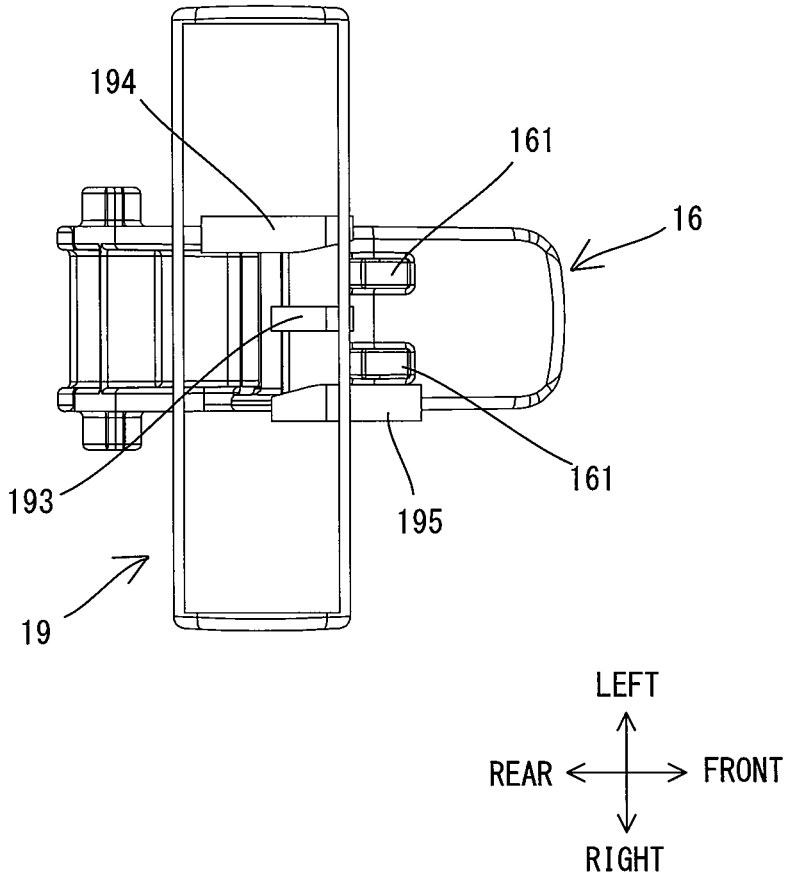
FIG. 12 is an explanatory drawing for illustrating the positional relation between the lock member in the lock-release position and the trigger in the frontmost position, when viewed from above.

As shown in FIG. 12, the first to third projections 193 to 195 each have a rectangular block-like shape. The first to third projections 193 to 195 have different sizes in the front-rear direction and are arranged at different positions in the front-rear direction. More specifically, the first projection 193 has the shortest length in the front-rear direction. The second projection 194 on the left of the first projection 193 is arranged such that the front end of the second projection 194 is at the same position as the front end of the first projection 193 in the front-rear direction and extends further rearward than the rear end of the first projection 193. The third projection 195 on the right of the first projection 193 is arranged such that the rear end of the third projection 195 is at the same position as the rear end of the first projection 193 in the front-rear direction and extends further forward than the front end of the first projection 193.

Further, as shown in FIG. 11, a projection is provided to protrude upward on a central upper end portion of the lock member 19. In the present modification, the projection has three recesses recessed downward. The central, left and right recesses are hereinafter referred to as a first recess 197, a second recess 198 and a third recess 199, respectively. The first recess 197 is provided in the center of the lock member 19 in the left-right direction. Like in the above-described embodiment, the flat spring 157 is disposed within the connection part 153. The flat spring 157 may be snap-engaged with one of the first to third recesses 197 to 199 via the protruding portion of the flat spring 157, thereby holding the lock member 19 in a specified position (where the protruding portion is engaged with the one of the first to third recesses 197 to 199).

The trigger-lock function and the locking function of the lock member 19 are now described.

In the present modification, as shown in FIG. 11, the position of the lock member 19 in which the protruding portion of the flat spring 157 is engaged with the first recess 197 (i.e. in which the centers of the lock member 19 and the handle 15 in the left-right direction coincide with each other) is set as a lock-release position. When the lock member 19 is placed in the lock-release position, the two projections 161 of the trigger 16 are respectively located between the first projection 193 and the second projection 194 and between the first projection 193 and the third projection 195 in the left-right direction. Thus, the trigger 16 is allowed to move between the frontmost position (see FIGS. 3 and 12) and the rearmost position (see FIGS. 4 and 14). Unless depressed, the trigger 16 is biased by the plunger 171 (see FIG. 2) and held in the frontmost position (i.e. the OFF position). Further, as shown in FIG. 12, when the trigger 16 is in the frontmost position, the front ends of the first and second projections 193, 194 are located at generally the same position as the rear ends of the projections 161 in the front-rear direction. Further, the front end of the third projection 195 is located forward of the rear ends of the projections 161 (more specifically, at generally the same position as the front ends of the projections 161) in the front-rear direction.

In this state, when a user pushes the left end portion of the lock member 19 to move the lock member 19 rightward from the lock-release position, the protruding part of the flat spring 157 is snap-engaged with the second recess 198 (see FIG. 11), and the lock member 19 is held in this position by the biasing force of the flat spring 157.

Figure 13:
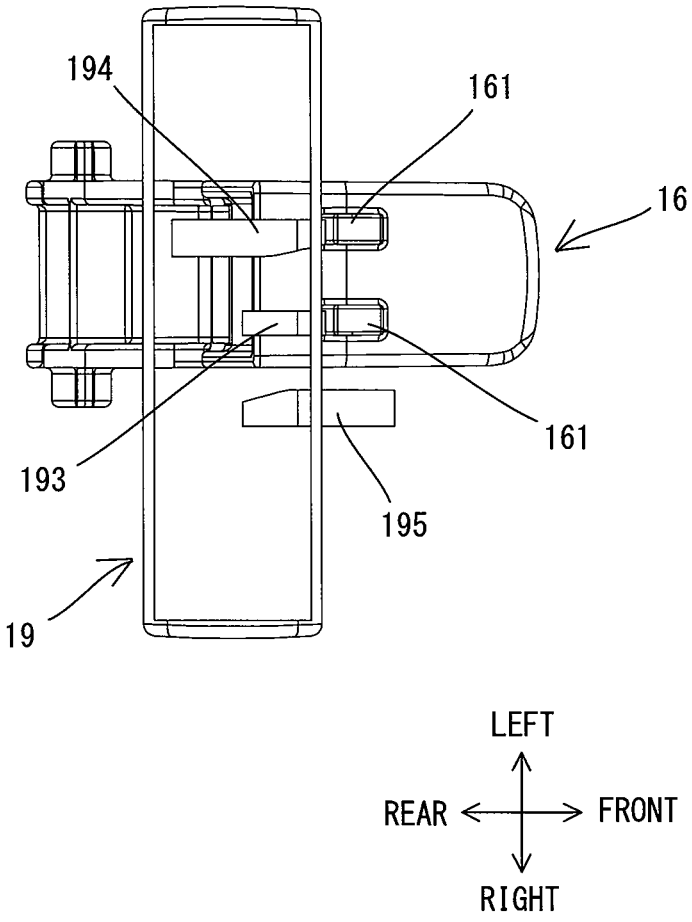
FIG. 13 is an explanatory drawing for illustrating the positional relation between the lock member in an OFF-lock position and the trigger locked in the OFF position by the lock member, when viewed from above.

In this position, as shown in FIG. 13, the first projection (central projection) 193 and the second projection (left projection) 194 of the lock member 19 are disposed behind the two projections 161 of the trigger 16 (on the moving paths of the first and second projections 193, 194 when the trigger 16 moves from the frontmost position toward the rearmost position). When the user depresses the trigger 16, the rear surfaces of the projections 161 of the trigger 16 abut on the front surfaces of the first and second projections 193, 194, so that the trigger 16 is prevented from further moving rearward and cannot reach the ON position. In other words, the lock member 19 locks the trigger 16 in the OFF position (performs the trigger-lock function) through engagement (abutment) between the first and second projections 193, 194 and the two projections 161. Accordingly, the position of the lock member 19 in which the protruding portion of the flat spring 157 is engaged with the second recess 198 is hereinafter also referred to as an OFF-lock position.

As shown in FIG. 12, when the user pushes the right end portion of the lock member 19 in a state in which the lock member 18 is in the lock-release position and the trigger 16 is held in the frontmost position (OFF position), the right projection 161 of the trigger 16 abuts on a left surface of the third projection 195 and thereby prevents the lock member 19 from further moving leftward. Thus, when the trigger 16 is disposed in the frontmost position, the user cannot move the lock member 19 leftward (toward an ON-lock position shown in FIG. 15) from the lock-release position.

Figure 14:
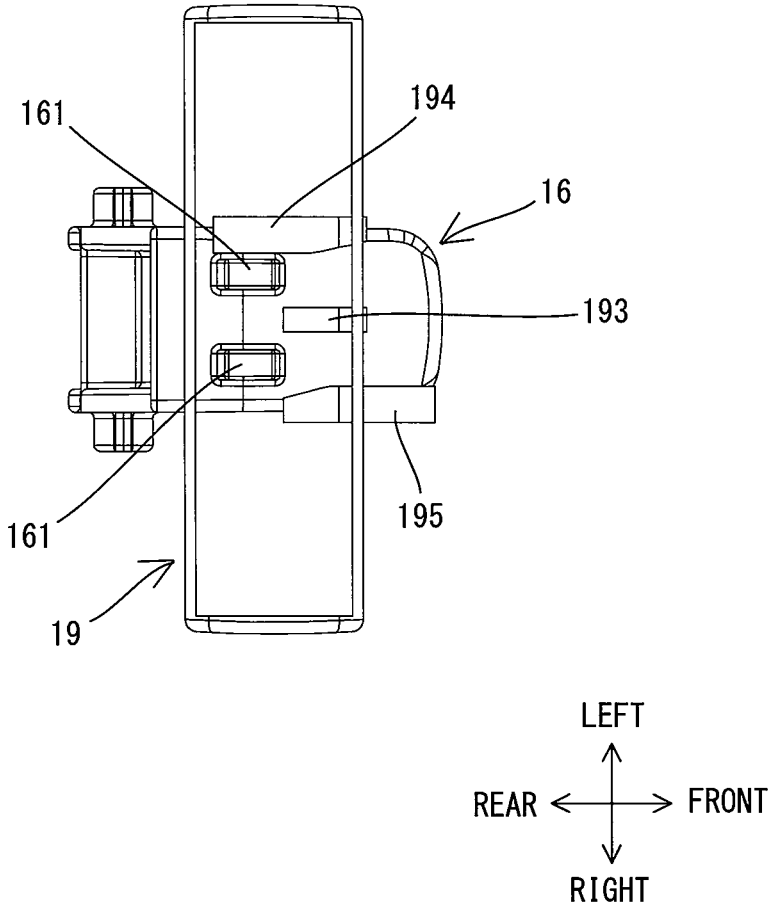
FIG. 14 is an explanatory drawing for illustrating the positional relation between the lock member in the lock-release position and the trigger in the rearmost position, when viewed from above.

When a user depresses the trigger 16 in a state in which the lock member 19 is in the lock-release position, as shown in FIG. 14, the trigger 16 can be moved up to the rearmost position. When the trigger 16 is placed in the rearmost position, the rear ends of the first and third projections 193, 195 are located at generally the same position as the front ends of the projections 161 in the front-rear direction, and the rear end of the second projection 194 is located rearward of the front ends of the projections 161 (specifically, at generally the same position as the rear ends of the projections 161) in the front-rear direction.

In this state, when the user pushes the right end portion of the lock member 19 to move the lock member 19 leftward from the lock-release position, the protruding portion of the flat spring 157 is snap-engaged with the third recess 199 (see FIG. 11) and the lock member 19 is held in this position by the biasing force of the flat spring 157.

Figure 15:
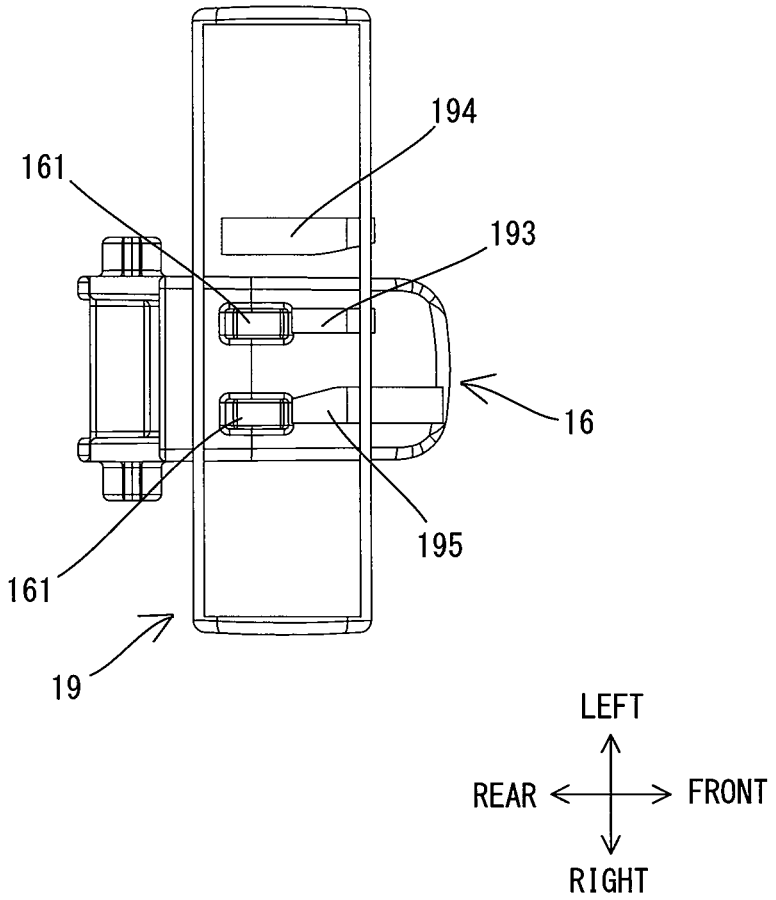
FIG. 15 is an explanatory drawing for illustrating the positional relation between the lock member in an ON-lock position and the trigger locked in the ON position by the lock member, when viewed from above.

In this position, as shown in FIG. 15, the first projection (central projection) 193 and the third projection (right projection) 195 of the lock member 19 are located in front of the two projections 161 of the trigger 16 (on the moving paths of the first and third projections 193, 195 when the trigger 16 moves from the rearmost position to the frontmost position). When the user releases the trigger 16, the front surfaces of the projections 161 of the trigger 16 abut on the rear surfaces of the first and third projections 193, 195, so that, although being biased forward by the plunger 171, the trigger 16 is prevented from further moving forward and cannot reach the OFF position. In other words, the lock member 19 locks the trigger 16 in the ON position (performs the on-lock function) through engagement (abutment) between the first and third projections 193, 195 and the two projections 161. Accordingly, the position of the lock member 19 in which the protruding portion of the flat spring 157 is engaged with the third recess 199 is hereinafter also referred to as an ON-lock position.

As shown in FIG. 14, when the user pushes the left end portion of the lock member 19 in a state in which the lock member 19 is in the lock-release position and the trigger 16 is held in the rearmost position (ON position), the left projection 161 of the trigger 16 abuts on a right surface of the second projection 194 and thereby prevents the lock member 19 from further moving rightward. Thus, when the trigger 16 is disposed in the rearmost position, the user cannot move the lock member 19 rightward (toward the OFF-lock position shown in FIG. 13) from the lock-release position.

As described above, in the present modification, the user can lock the trigger 16 in the ON position by moving the single lock member 19 leftward from the lock-release position, and can lock the trigger 16 in the OFF position by moving the lock member 19 rightward from the lock-release position. In other words, two different operating (moving) directions (leftward and rightward) are set, using the lock-release position as a reference position, for the two different functions of the lock member 19 (i.e. the function of locking the trigger 16 in the ON position and the function of locking the trigger 16 in the OFF position). Thus, the user can easily understand how to operate the lock member 19. Further, for example, a mark or other similar indicator indicating an operating direction and a corresponding function may be provided on an upper surface of the lock member 19 or the connection part 153, in order to make it easier for the user to understand an appropriate operating direction.

Further, in the present modification, the trigger 16 (specifically, the projections 161) is configured to restrict a leftward movement of the lock member 19 from the lock-release position when the trigger 16 is in the OFF position, and to restrict a rightward movement of the lock member 19 from the lock-release position when the trigger 16 is in the ON position. More specifically, the lock member 19 has the second projection 194 and the third projection 195 which are arranged at different positions in the front-rear direction and spaced apart from each other in the left-right direction (i.e. the moving direction of the lock member 19). In the frontmost position (i.e. OFF position), the trigger 16 (the projections 161) abuts on the third projection 195, which is arranged forward of the second projection 194, thereby preventing the further leftward movement of the lock member 19. In the rearmost position (i.e. ON position), the trigger 16 abuts on the second projection 194, which is arranged rearward of the third projection 195, thereby preventing a further rightward movement of the lock member 19. Therefore, when the trigger 16 is located in the frontmost position, the lock member 18 can be moved to the OFF-lock position, but not to the ON-lock position. Further, when the trigger 16 is located in the rearmost position, the lock member 18 can be moved to the ON-lock position, but not to the OFF-lock position. Therefore, the user can easily recognize a direction to move the lock member 19, depending on the position of the trigger 16, and the lock member 19 can perform an appropriate function depending on the position of the trigger 16.

In the present modification, the first and third projections 193, 195 of the lock member 19 are configured to lock the trigger 16 in the ON position by abutting on the projections 161 on the front of the projections 161 of the trigger 16 when the lock member 19 is disposed in the ON-lock position. Further, the first and second projections 193, 194 are configured to lock the trigger 16 in the OFF position by abutting on the projections 161 on the rear of the projections 161 of the trigger 16 when the lock member 19 is disposed in the OFF-lock position. In this manner, also in the present modification, the lock member 19 which is capable of locking the trigger 16 in the OFF position and also in the ON position is realized in a compact, simple and easy-to-operate structure.

In the present modification, the lock member 19 is an example that corresponds to each of the "first lock member", the "second lock member" and the "single lock member". The ON-lock position, the OFF-lock position and the lock-release position of the lock member 19 are examples that correspond to the "specified position", the "lock position" and the "lock-release position", respectively. Each of the projections 161 of the trigger 16 is an example that corresponds to the "first interference part". Each of the first to third projections 193 to 195 is an example that corresponds to the "second interference part". Each of the first and third projections 193, 195 is an example that corresponds to the "ON-lock part". Each of the first and second projections 193, 194 is an example that corresponds to the "OFF-lock part".

Further, in a structure in which the switch 17 is held in the ON state when the trigger 16 is located within a certain range, like the range (including the switching position) between the switching position and the rearmost position in the above-described embodiment and modification, the controller 27 may control a rotation speed of the motor 2 such that the rotation speed increases as a depressed amount of the trigger 16 increases. In this case, it may be preferred that the lock member 18, 19 is capable of locking the trigger 16 in the ON position which corresponds to the maximum rotation speed of the motor 2. Alternatively, the lock member 18, 19 may be capable of locking the trigger 16 in a plurality of ON positions (different ON positions in the front-rear direction) which respectively correspond to different rotation speeds of the motor 2. For example, a plurality of projections each having a rear surface arranged in a different position in the front-rear direction from the other may be provided on the trigger 16 and the lock member 18, 19.

In the above-described embodiment, the on-lock function and the trigger-lock function are realized by engagement (abutment) between the two projections 184 of the lock member 18 and the two projections 161 of the trigger 16. The numbers of the projections 184 and 161 may, however, be one, three or more. Further, the engagement (abutment) between the lock member 18 and the trigger 16 when the lock member 18 is in the lock position may be realized by structures other than the projections 184 and 161. For example, a rod-like lock member may be arranged to be movable in the left-right direction or in the up-down direction between a lock position, in which the lock member is partially located on the moving path of the upper end of the trigger 16, and a lock-release position, in which the lock member is entirely located out of the moving path. In this case, like the above-described embodiment, the on-lock function and the trigger-lock function can be realized with the single lock member by arranging the lock member in a position corresponding to the projections 184 of the above-described embodiment in the front-rear direction. Further, the lock member may be of a rotary type, instead of the linearly sliding type. The lock member need not be disposed on an upper side of the grip part 151 (within the connection part 153), but may be disposed, for example, within the grip part 151.

Similar changes may also be made to the lock member 19. For example, the lock member 19 may have only the first projection 193. In this case, when the lock member 19 is in the ON-lock position, the first projection 193 can lock the trigger 16 in the ON position by abutting on the left projection 161 on the front of the left projection 161 of the trigger 16. Further, when the lock member 19 is in the OFF-lock position, the first projection 193 can lock the trigger 16 in the OFF position by abutting on the right projection 161 on the rear of the right projection 161.

Alternatively, for example, the lock member 19 may have only the first and second projections 193, 194, and the trigger 16 has only the left projection 161. In this case, when the lock member 19 is in the ON-lock position, the first projection 193 can lock the trigger 16 in the ON position by abutting on the projection 161 on the front of the projection 161. Further, when the lock member 19 is in the OFF-lock position, the second projection 194 can lock the trigger 16 in the OFF position by abutting on the projection 161 on the rear of the projection 161. In this case, the rear end of the second projection 194 may be arranged at the same position as the rear end of the first projection 193 in the front-rear direction. Further, the front end of the first projection 193 may be arranged forward of the front end of the second projection 194, that is, forward of the rear end of the projection 161 of the trigger 16 when the trigger 16 is in the OFF position.

Further, the lock member 19 may have two projections having the same shape and arranged at the same position in the front-rear direction, and the trigger 16 may have three projections arranged at different positions in the front-rear direction. In other words, the projections of the lock member 19 and the trigger 16 may be replaced with each other. In this case, as described above, the number, arrangement and size of the projections may also be appropriately changed.

The structure for holding the lock member 18 in the lock position and in the lock-release position is not limited to the flat spring 157 and the first and second recesses 188, 189, but may be appropriately changed. For example, the flat spring 157 may be provided on the lock member 18, and the first and second recesses 188, 189 may be provided in the connection part 153. Alternatively, for example, a flexible locking piece may be provided on one of the lock member 18 and the connection part 153, and a groove which can be engaged with the locking piece may be provided on the other. Similar changes may also be made to the structure for holding the lock member 19 in the ON-lock position, the OFF-lock position and the lock-release position.

Further, for example, the power source of the electric hammer 1 may be an external alternate current (AC) source, instead of the removably mounted battery 93. The structures of the motor 2, the motion-converting mechanism 3 and the striking mechanism 4 may also be appropriately changed. For example, an AC motor having a brush may be employed as the motor 2. A well-known motion-converting mechanism having a swinging member may be employed as the motion-converting mechanism 3, in place of the crank mechanism.

In view of the nature of the present invention and the above-described embodiment, the following aspects are provided. The following aspects can be employed in combination with any of the electric hammer 1 of the embodiment and the above-described modifications, or in combination with the claimed invention.

(Aspect 1)

The second lock member may be movable between a lock position and a lock-release position in response to an external operation by a user, the second lock member in the lock position being capable of locking the operation member in the OFF position by partially interfering with the operation member on a moving path of the operation member, the second lock member in the lock-release position being entirely out of the moving path.

(Aspect 2)

The lock member may be movable between a lock position and a lock-release position in response to an external operation by a user, the lock member in the lock position being capable of locking the operation member both in the ON position and in the OFF position, the lock member in the lock-release position allowing the operation member to move between the OFF position and the ON position.

(Aspect 3)

In Aspect 2, the lock member may be configured to partially interfere with the operation member on a moving path of the operation member when the lock member is in the lock position, and to be entirely out of the moving path of the operation member when the lock member is in the lock-release position.

(Aspect 4)

The operation member may be provided on a front portion of the grip part so as to be movable in the front-rear direction, and the second lock member or the lock member may be disposed to be movable in a left-right direction, which is orthogonal to the front-rear direction and to the up-down direction.

(Aspect 5)

The first interference part may comprise a projection protruding toward the lock member, and the second interference part may comprise a projection protruding toward the operation member.

(Aspect 6)

The holding mechanism may be configured to hold the second lock member in the lock position and in the lock-release position by snap-engagement.

(Aspect 7)

The holding mechanism may be configured to release the second lock member in response to an external operation of the second lock member, regardless of an external operation of the operation member.

(Aspect 8)

The lock member may be movable in a direction orthogonal to the drive axis, and the first direction and the second direction may be opposite to each other.

(Aspect 9)

The holding mechanism may be configured to hold the lock member in the specified position, the lock position and the lock-release position.

(Aspect 10)

The operation member may be configured to:

allow the lock member to move from the lock-release position only in the second direction when the operation member is in the OFF position, and allow the lock member to move from the lock-release position only in the first direction when the operation member is in the ON position.

(Aspect 11)

The operation member may be provided in a front portion of the grip part so as to be movable in the front-rear direction, the lock member may be movable in a direction crossing the front-rear direction, the lock member may have a first abutment part and a second abutment part, the first and second abutment parts being arranged at different positions in the front-rear direction and spaced apart from each other in a moving direction of the lock member, the first abutment part being arranged forward of the second abutment part, and the operation member may be configured to:

abut on the first abutment part when the operation member is in the OFF position, thereby restricting the lock member from moving in the first direction, and abut on the second abutment part when the operation member is in the ON position, thereby restricting the lock member from moving in the second direction.

The third projection 195 and the second projection 194 of the above-described modification are examples that correspond to the "first abutment part" and the "second abutment part", respectively, according to the present aspect.

(Aspect 12)

In Aspect 11, the operation member may have a receiving part configured to abut on the first and second abutment parts.

(Aspect 13)

In Aspect 12, the receiving part may comprise at least one projection protruding toward the lock member.

The projection 161 of the above-described modification is an example that corresponds to each of the "receiving part" and the "projection" according to aspects 12 and 13, respectively.

(Aspect 14)

In Aspect 12 or 13, the first abutment part may be configured to lock the operation member in the ON position by abutting on a front surface of the receiving part when the lock member is in the specified position, and the second abutment part may be configured to lock the operation member in the OFF position by abutting on a rear surface of the receiving part when the lock member is in the lock position.

(Aspect 15)

In any one of aspects 11 to 14, each of the first and second abutment parts may comprise a projection protruding toward the operation member.

(Aspect 16)

The first interference part may comprise at least one projection protruding toward the operation member.

(Aspect 17)

The second interference part may comprise at least one projection protruding toward the lock member.

DESCRIPTION OF NUMERALS

1: electric hammer, 10: body housing, 11: driving-mechanism-housing part, 13: motor-housing part, 15: handle, 151: grip part, 153: connection part, 154: through hole, 155: through hole, 156: connection part, 157: flat spring, 159: battery-mounting part, 16: trigger, 161: projection, 162: front surface, 163: rear surface, 17: electric switch, 170: body, 171: plunger, 18: lock member, 181: left end part, 182: right end part, 184: projection, 185: front surface, 186: rear surface, 188: first recess, 189: second recess, 19: lock member, 193: first projection, 194: second projection, 195: third projection, 197: first recess, 198: second recess, 199: third recess, 2: motor, 21: rotor, 23: motor shaft, 27: controller, 3: motion-converting mechanism, 31: crank shaft, 33: connection rod, 35: piston, 37: cylinder, 39: tool holder, 4: striking mechanism, 41: striker, 43: impact bolt, 91: tool accessory, 93: battery, A1: drive axis

What is claimed is:

1. An impact tool configured to only linearly drive a tool accessory along a drive axis extending in a front-rear direction, the impact tool comprising:

an elongate grip part extending in an up-down direction orthogonal to the drive axis;

a switch for driving the tool accessory;

a trigger (1) that is an elongate lever extending in the up-down direction, (2) supported by the grip part to be pivotable about an axis (i) extending in a crossing direction perpendicular to the up-down direction and the front-rear direction and (ii) at a lower end portion of the trigger, (3) configured to be pivoted between an OFF position and an ON position, the trigger in the OFF position holding the switch in an OFF state and the trigger in the ON position holding the switch in an ON state (4) having a forwardmost edge configured to be contacted by a finger of a user of the power tool and (5) having a plurality of first projections that (i) protrude upwardly at an upper end portion of the trigger and (ii) are spaced apart in the crossing direction;

a lock member (1) above a portion of the forwardmost edge in the up-down direction both when the trigger is in the OFF position and when the trigger is in the ON position, (2) configured to (i) be movable in the crossing direction between a single lock position and a lock-release position in response to an external operation by the user, (ii) lock the trigger either in the OFF position or in the ON position when the lock member is in the single lock position, and (iii) allow the trigger to move between the OFF position and the ON position when the lock member is in the lock-release position and (3) having a plurality of second projections that (i) protrude downward toward the trigger and (ii) are spaced apart in the crossing direction; and a holding mechanism configured to hold the lock member in the single lock position or in the lock-release position, wherein the first projections and the second projections are configured such that (1) front surfaces of the second projections abut rear surfaces of the first projections to lock the trigger in the OFF position and (2) rear surfaces of the second projections abut front surfaces of the first projections to lock the trigger in the ON position.

2. The impact tool as defined in claim 1, wherein:

the holding mechanism includes a biasing member, and the holding mechanism is configured to hold the lock member in the single lock position or in the lock-release position by a biasing force of the biasing member.

3. The impact tool as defined in claim 1, wherein:

both end portions of the lock member in a moving direction of the lock member are accessible by a user from an exterior of a housing that houses the lock member; and the end portions of the lock member have different dimensions in a direction orthogonal to the moving direction.

4. The impact tool as defined in claim 1, further comprising a battery-mounting part configured to removably receive a rechargeable battery.

5. The impact tool as defined in claim 4, wherein the trigger is above the battery-mounting part, the lock member is above the trigger, and the lock member, the trigger and the battery-mounting part are configured such that a straight line in the up-down direction intersects portions of the lock member, the contact surface and the battery-mounting part.

6. The impact tool as defined in claim 1, wherein a portion of each of the first projections is between a front end of the lock member and a rear end of the lock member in the front-rear direction both when the trigger is in the OFF position and when the trigger is in the ON position.

7. The impact tool as defined in claim 1, wherein a portion of the forwardmost edge of the trigger is between a front end of the lock member and a rear end of the lock member in the front-rear direction both when the trigger is in the OFF position and when the trigger is in the ON position.

8. The impact tool as defined in claim 7, wherein:

the switch includes a body and a plunger that protrudes forward from the body, and the plunger abuts a rear surface of a portion of the trigger that has the forwardmost edge and biases the trigger forward toward the OFF position.

9. The impact tool as defined in claim 8, wherein the plunger abuts a central portion of the trigger in the up-down direction.

10. The impact tool as defined in claim 1, wherein a body of the switch is directly behind the trigger within the grip part.

11. The impact tool as defined in claim 10, wherein an entirety of the body of the switch is located rearward of the lock member in the front-rear direction.

* * * * *